US005501380A

United States Patent [19]

Wu

[11] Patent Number: 5,501,380

[45] Date of Patent: Mar. 26, 1996

[54] SAFETY HOLSTER FOR HANDGUN

[76] Inventor: Kuang-Li Wu, 4669 W. Highway 192, Kissimmee, Fla. 34746

[21] Appl. No.: 353,685

[22] Filed: Dec. 12, 1994

[51] Int. Cl.[6] ..... F41C 33/02

[52] U.S. Cl. ..... 224/243; 224/911; 224/912

[58] Field of Search ..... 224/911, 912, 224/236, 243, 238, 904; 150/118, 143, 149, 102; 190/120

[56] References Cited

U.S. PATENT DOCUMENTS

| | | | |
|---|---|---|---|
| 2,297,008 | 9/1942 | McMillan | 224/2 |
| 3,113,796 | 12/1963 | Neil | 224/243 |
| 3,276,646 | 10/1966 | Coggins, Jr. | 224/911 |
| 3,904,091 | 9/1975 | Jones | 224/243 |
| 4,318,503 | 3/1982 | Capano | 224/244 |
| 4,750,655 | 6/1988 | Barry | 224/243 |
| 4,815,641 | 3/1989 | Bianchi et al. | 224/238 |
| 4,817,769 | 4/1989 | Saliba | 190/120 |
| 4,828,154 | 5/1989 | Clifton, Jr. | 224/904 |
| 4,858,799 | 8/1989 | Young | 224/243 |
| 4,886,197 | 12/1989 | Bowles et al. | 224/243 |
| 4,962,800 | 10/1990 | Owiriwo | 150/118 |
| 5,108,019 | 4/1992 | Woodward et al. | 224/243 |
| 5,127,566 | 7/1992 | Beletsky | 224/243 |
| 5,269,448 | 12/1993 | Shoemaker | 224/243 |
| 5,322,200 | 6/1994 | Blanchard | 224/192 |

FOREIGN PATENT DOCUMENTS

| | | | |
|---|---|---|---|
| 1139775 | 11/1962 | Germany | 224/911 |

*Primary Examiner*—Henry J. Recla
*Assistant Examiner*—Gregory M. Vidovich
*Attorney, Agent, or Firm*—James H. Beusse

[57] ABSTRACT

A safety holster for a handgun comprises a holster adapted for receiving a barrel and receiver portion of a handgun with a handgrip and hammer portion extending outward of the holster. The holster has an outer surface and a reverse surface with a belt loop attached to the reverse surface of the holster for enabling the holster to be carried on a person's belt. A flexible strap has one end attached to the reverse surface of the holster and a second end extendable over at least the hammer portion of the handgun to the outer surface. A two-member locking device has a first, fixed member attached to the outer surface of the holster and a second, releasable member attached to the second end of the strap. The releasable member comprises at least two spaced cross-pieces integrally formed within a slotted area of the releasable member and the strap is looped over and around the cross-pieces so that the releasable member is adjustably coupled to the strap. In another form, the strap comprises a flap which overlays the handle portion of the handgun.

10 Claims, 3 Drawing Sheets

SAFETY HOLSTER FOR HANDGUN

BACKGROUND OF THE INVENTION

The present invention relates to a holster for carrying a handgun and, more particularly, to a conventional style holster adapted for wearing on a belt and which includes an integral locking mechanism for preventing removal of the handgun from the holster.

There are numerous prior art devices which have been developed in order to secure handguns. The devices range from trigger locks to steel storage boxes or cabinets. Some of the devices particularly adapted for handguns include electronic apparatus for sounding an alarm when a handgun is removed from a holster. Another inventor has incorporated a pivotable locking arm that is held in place on a holster by a locking screw.

More recently, U.S. Pat. No. 5,322,200 describes a steel storage case having the general form of a holster in that the apparatus receives the barrel end of a handgun with the grip end of the handgun exposed. A plastic wrapped steel cable is welded at one end to one side of the steel case with the remaining free end formed into a loop. A latch is welded to another side of the steel case with the latch being sized to pass through the loop on the cable. The latch has an opening for receiving a conventional pad lock. It is intended that a handgun be retained in this lockable storage case by looping the cable over the handgun and attaching the cable to the latch. The steel case includes a one-half inch thick steel plate attached to a side opposite the latch with the steel plate being drilled to accept passage of a pair of lag bolts for fixedly mounting the case to a wall or other fixed mount. The only perceivable difference between this steel case and prior steel cabinets or storage boxes is that the grip end of the handgun is visible in the case.

There are at least two disadvantages of the above described steel storage case. A first disadvantage is that the case must be uniquely sized to fit a handgun to be stored in the case, first because the case is formed of a non-resilient steel and secondly because the cable is fixed to the case in such a manner as not to be adjustable to different sizes. A second disadvantage is that the case is not intended to be transportable and therefore the handgun must be removed from the case for transport, thus making the handgun accessible and defeating a primary function of the case.

SUMMARY OF THE INVENTION

Among the several objects of the present invention may be noted the provision of a safety holster for a handgun which is adaptable to different sizes and types of handguns and the provision of a safety holster which is usable as a conventional holster without defeating the safety aspects of the holster.

The above and other objects, features and advantages will be in part apparent and in part pointed out in the description to follow. In an illustrative embodiment, a safety holster is described as constructed from or in the form of a conventional leather or fabric handgun holster and includes a strap of a non-elastic material attached at one end to one side of the holster. Another end of the strap is fitted with one member of a two member locking device with the second member of the locking device attached to another side of the holster. The one member is adjustably connected to the strap so that the length of the strap is adjustable to accommodate different sizes and styles of handguns. In a preferred form, the locking device is a snap-type lock having an integral combination locking mechanism.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
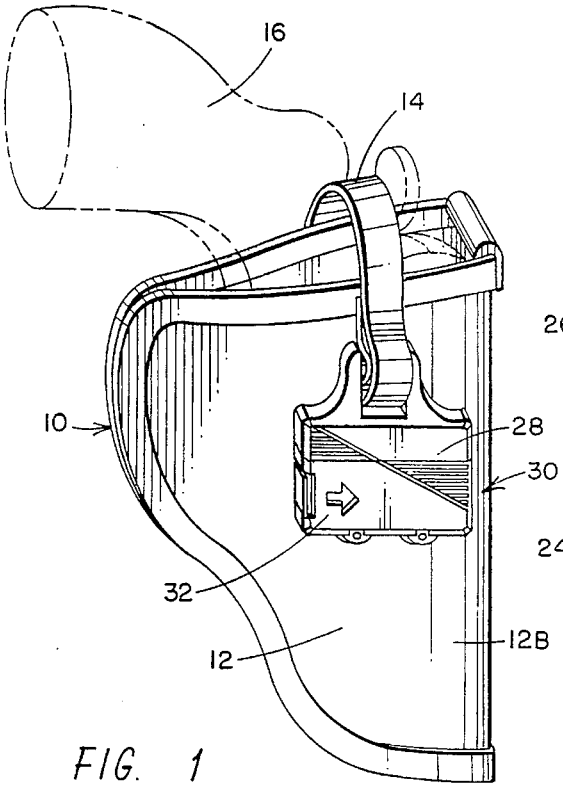
FIG. 1 is an illustration of an outer side of the inventive safety holster in a normal wearing position.
Figure 2:
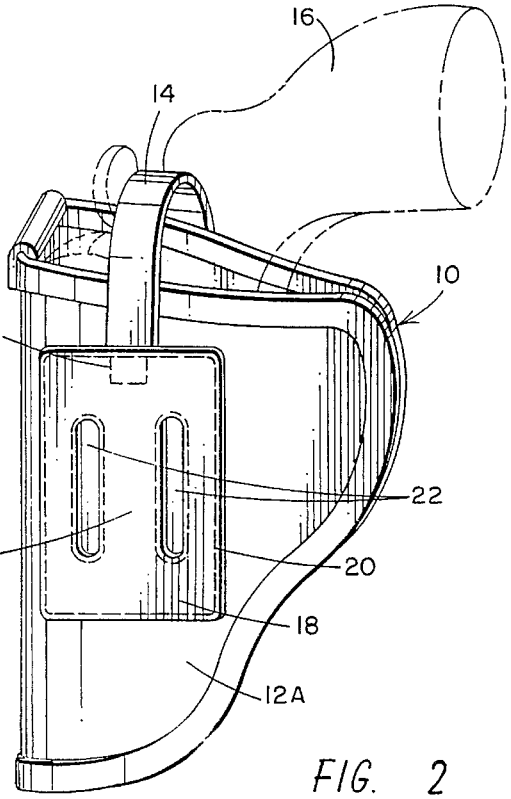
FIG. 2 is an illustration of a reverse side of the safety holster of FIG. 1.

Referring to the drawings in general and in particular to FIGS. 1 and 2, a safety holster 10 in accordance with the present invention comprises a conventional style holster 12 of fabric or leather fitted with a strap 14 for retaining a handgun 16 in the holster. The holster 12 is designed to be worn on a belt and includes a rectangular patch 18 sewn to a reverse side 12A of the holster. The patch 18 is sewn around its periphery as indicated at 20 and includes a pair of slots 22 defining a belt loop 24 therebetween. One end of the strap 14 is sewn under patch 18 as shown at 26. An opposite end of strap 14 is attached to a releasable member 28 of a two-member locking device 30 having a second member 32 fixed to a front or outer side 12B of holster 12. It should be noted that patch 18 could be sewn to holster 10 only at its top and bottom edges leaving the side edges free for passage of a belt thus eliminating the need for slots 22.

Figure 3:
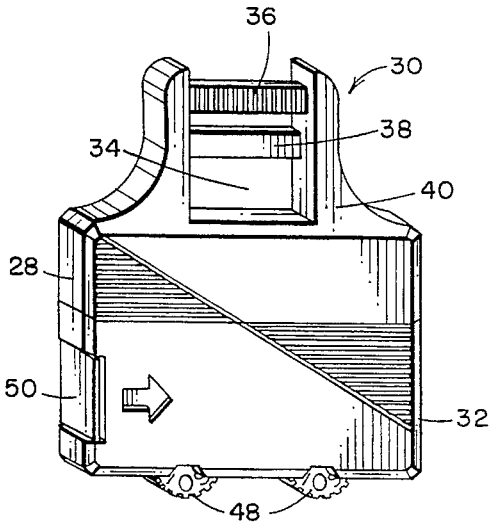
FIG. 3 illustrates the locking mechanism for the present invention in a closed position.
Figure 4:
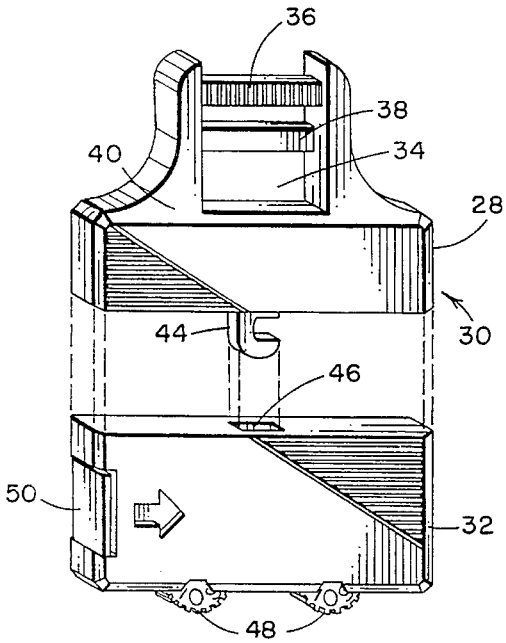
FIG. 4 illustrates the locking mechanism of FIG. 3 in an open position.
Figure 5:
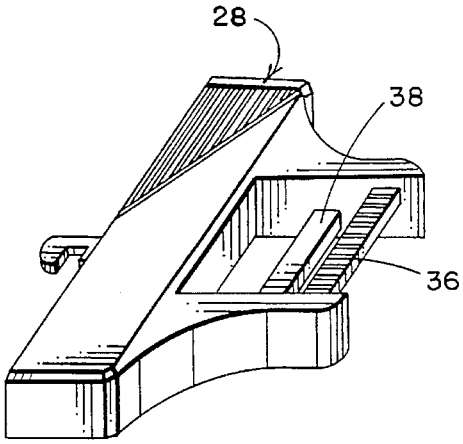
FIG. 5 is a perspective view of the releasable portion of the locking mechanism.
Figure 6:
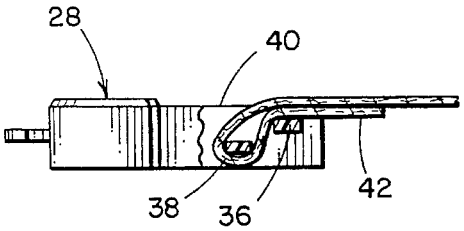
FIG. 6 is a partial cross-sectional view of the releasable portion of the locking mechanism.

FIGS. 3 and 4 illustrate more details of the locking device 30. While other forms of the locking device may be used for device 30, the illustrated form of locking device is believed to be the best adapted for this purpose. Referring to FIGS. 5 and 6 in conjunction with FIGS. 3 and 4, the member 28 includes a slotted portion 34 having a pair of cross-pieces 36 and 38. The upper cross-piece 36 is recessed below the outer surface 40 of member 28 by an amount sufficient to allow strap 14 to lie flush with surface 40 when member 28 is coupled to strap 14. The surface of cross-piece 36 may be serrated or erose as shown to provide a gripping surface for strap 14.

The second cross-piece 38 is positioned below the level of cross-piece 36 with respect to outer surface 40 and the top of member 28. Referring specifically to FIG. 6, strap 14 is looped around cross-piece 38 with the free end 42 in contact with cross-piece 36 and lying under the major portion of strap 14 so that when strap 14 is pulled tight, it becomes locked in position on member 28. The length of strap 14 between member 28 and patch 18 is adjustable when member 28 is released to remove tension from strap 14.

Referring again to FIGS. 3 and 4, member 28 includes a latch 44 which fits into a mortise 46 in member 32. A spring loaded catch (not shown) engages latch 44 and holds member 28 in locking relationship with member 32. The member 32 includes a pair of combination wheels 48 which prevent release of member 28 from member 32 unless both wheels 48 are turned to a given combination. A push-button release 50 can be depressed to cause member 28 to separate from member 32 when wheels 48 are rotated to the correct combination. The illustrative locking device 30, without the particular strap attaching means 34, 36 and 38, is available from Shopin Lock. Co. of Changhun, Taiwan under their model number CP-2001-1. Applicant has modified this lock by redesigning member 28 to add the upper portion for attachment of strap 14.

Figure 7:
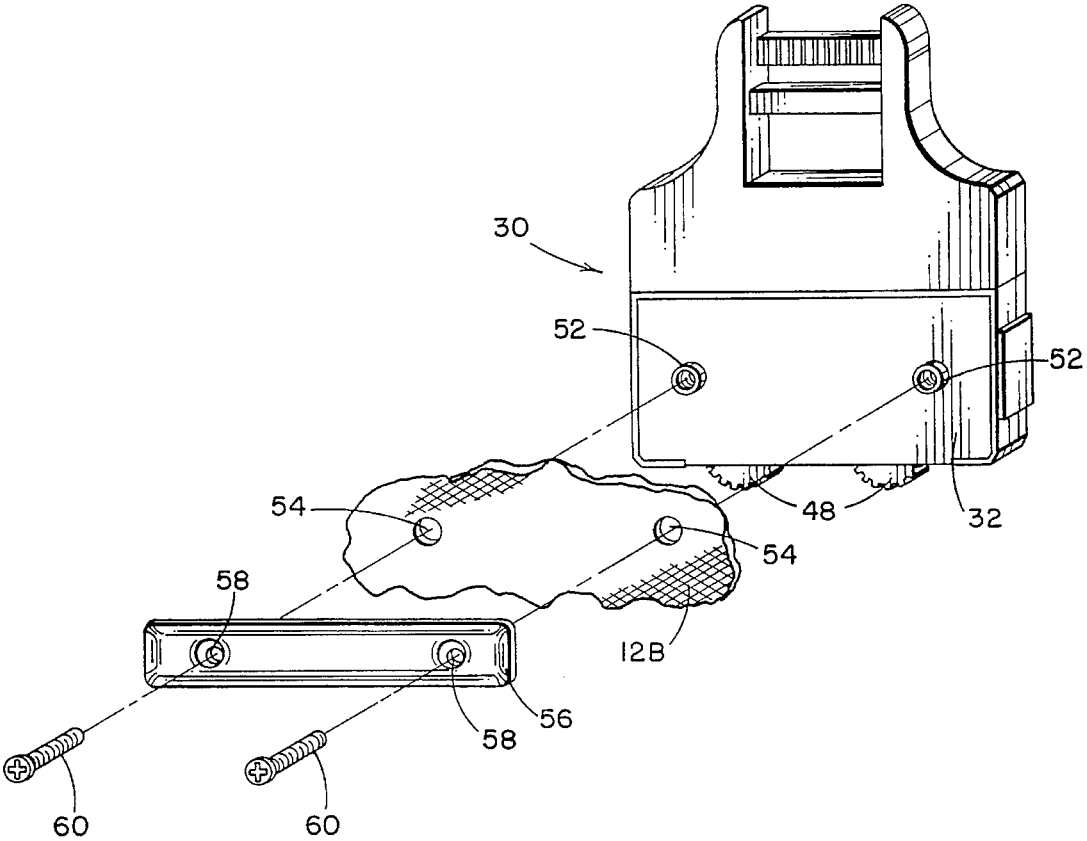
FIG. 7 is a reverse cutaway view of the holster show attachment of the locking mechanism.

Referring to FIG. 7, the reverse side of lock member 32 includes a pair of threaded, tubular extensions 52 which are used to attach member 32 to the front surface 12B of holster 10. The extensions fit into a pair of apertures 54 in the front of holster 10. A backing plate 56 is placed inside holster 10 overlying member 32 and includes apertures 58 for passing screws 60 into extensions 52. Tightening of screws 60 attaches lock member 32 to holster 10.

Figure 8:
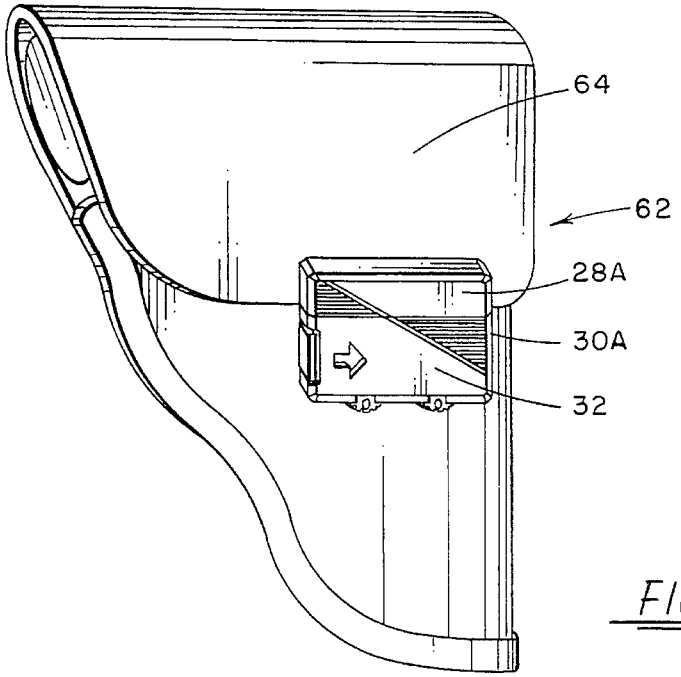
FIGS. 8 and 9 show the present invention incorporated in a military style holster with flap.
Figure 9:
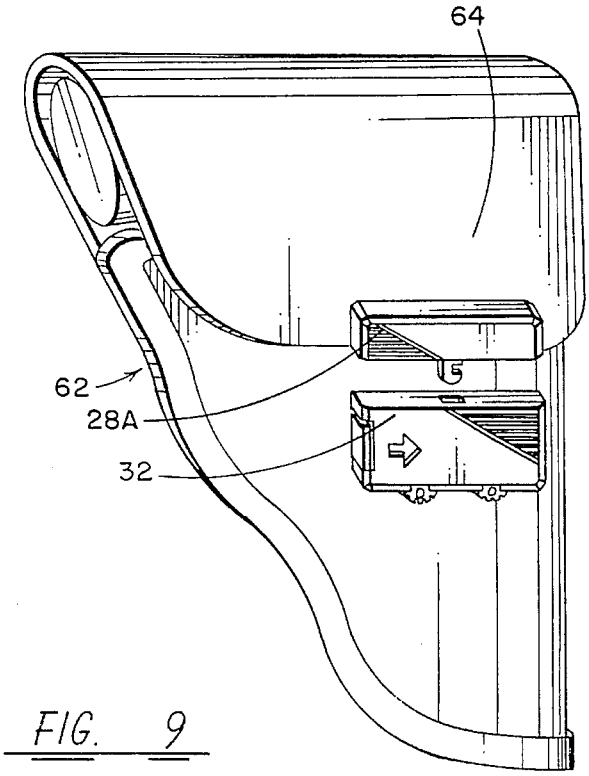

Turning now to FIGS. 8 and 9, there is shown a military style holster 62 having a flap 64 and a locking device 30A. Locking device 30A is substantially identical to the device 30 of FIG. 3 except that the releasable member 28A is formed without the slotted portion 34. The member 28A may include the same type of fastening means as shown for member 32 in FIG. 7, i.e., a pair of threaded extensions for receiving screws extending through holes in the flap 64. The fixed member 32 is attached in the same manner as shown in FIG. 7.

Figure 10:
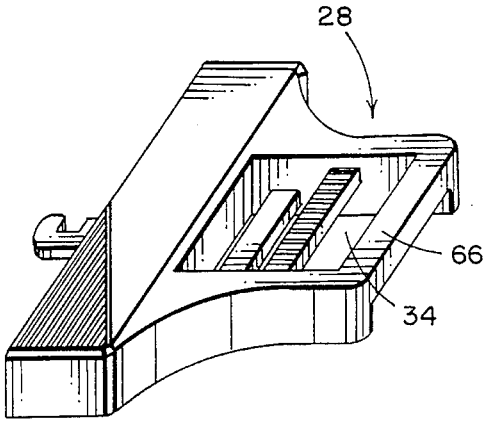
FIG. 10 shows an alternative form of releasable portion of the locking mechanism.

FIG. 10 illustrates an alternate form of releasable locking member 28 in which the slotted portion 34 has three cross-pieces rather than two. The additional cross-piece 66 makes it more difficult to release strap 14 and enhance the safety of the holster.

While the invention has been described in what is presently considered to be a preferred embodiment, many variations and modifications will become apparent to those skilled in the art. Accordingly, it is intended that the invention not be limited to the specific illustrative embodiment but be interpreted within the full spirit and scope of the appended claims.

What is claimed is:

1. A safety holster for a handgun comprising:

a holster adapted for receiving a barrel and receiver portion of a handgun with a handgrip and hammer portion of the handgun extending outward of the holster, said holster having an outer surface and a reverse surface with a belt loop means attached to said reverse surface of said holster for enabling said holster to be carried on a person's belt;

a flexible strap having one end attached to said reverse surface of said holster and having a second end extendable over at least the hammer portion of the handgun to said outer surface of said holster;

a two-member locking device having a first, fixed member attached to said outer surface of said holster and having a second, releasable member attached to said second end of said strap; and said locking device comprising a combination lock requiring setting of a unique combination for releasing said second member from said first member.

2. The safety holster of claim 1 wherein said releasable member comprises at least two spaced cross-pieces integrally formed within a slotted area of said releasable member and wherein said strap is attached to said releasable member by looping said strap over and around said cross-pieces, said releasable member being thereby adjustably coupled to said strap.

3. The safety holster of claim 1 wherein said strap comprises a flap overlaying the handle and hammer portion of the handgun.

4. The safety holster of claim 1 wherein said combination lock for latching said releasable member comprises a lock having a plurality of rotatable wheels for selecting said unique combination.

5. The safety holster of claim 2 wherein each of said at least two cross-pieces are recessed below an outer surface of said releasable member whereby said strap lies coincident with said outer surface of said releasable member.

6. The safety holster of claim 3 wherein said releasable member is fixedly attached to said flap.

7. The safety holster of claim 6 wherein said releasable member includes a pair of spaced, threaded extensions protruding from a rear surface thereof, said flap being formed with a pair of spaced holes adapted for mating with said extensions on said releasable member, and said releasable member being attached to said flap by threaded fasteners extending through said flap into said extensions.

8. The safety holster of claim 1 wherein said fixed member includes a pair of spaced extensions protruding from a rear surface thereof, said extensions protruding through a pair of mating holes in said holster, and said fixed member being attached to said holster by threaded fasteners extending through said holes into said extensions.

9. The safety holster of claim 2 wherein at least one of said at least two cross-pieces is formed with a serrate surface, said strap having a portion thereof compressed against said serrate surface for inhibiting movement of said strap when said strap is in tension.

10. The safety holster of claim 9 and including a third cross-piece for reacting against said strap to inhibit release thereof.

* * * * *